US005762411A

United States Patent [19]

Yemini

[11] Patent Number: 5,762,411

[45] Date of Patent: Jun. 9, 1998

[54] TOOL BOX WITH FOLDING BINS

[75] Inventor: Zvi Yemini, Tel Aviv, Israel

[73] Assignee: Zag Ltd., Rosh Haayin, Israel

[21] Appl. No.: 761,889

[22] Filed: Dec. 9, 1996

Related U.S. Application Data

[63] Continuation-in-part of Ser. No. 700,018, Aug. 20, 1996, abandoned.

[51] Int. Cl.[6] ..... A47B 81/00

[52] U.S. Cl. ..... 312/290; 312/902; 312/327; 252/210

[58] Field of Search ..... 312/216, 215, 312/902, 328, 327, 290, 283; 206/373, 372; 292/114, 125, 107, 209, 210; 220/558, 532, 735, 23.86, 28.83, 326, 324

[56] References Cited

U.S. PATENT DOCUMENTS

| | | | |
|---|---|---|---|
| 892,969 | 7/1908 | Wilson | 312/290 X |
| 1,510,240 | 9/1924 | Myers | 312/330.1 X |
| 1,514,885 | 11/1924 | Bigler | 206/373 X |
| 2,286,427 | 6/1942 | Levensten | 312/290 X |
| 2,537,669 | 1/1951 | Honig | 312/269 |
| 2,630,362 | 3/1953 | Bass | 312/290 X |
| 2,895,782 | 7/1959 | Fragale | 312/290 |
| 4,212,410 | 7/1980 | Galer | 220/324 |
| 4,790,610 | 12/1988 | Welch et al. | 312/216 X |
| 5,339,956 | 8/1994 | Thomason | 206/373 X |
| 5,423,404 | 6/1995 | Shaw | 206/372 X |
| 5,439,108 | 8/1995 | Lackie | 206/373 |
| 5,456,357 | 10/1995 | Wenner et al. | 206/373 X |
| 5,458,409 | 10/1995 | Sheng | 312/216 |

*Primary Examiner*—Peter M. Cuomo
*Assistant Examiner*—Janet M. Wilkens
*Attorney, Agent, or Firm*—Mark M. Friedman

[57] ABSTRACT

A tool box with external pivoting bins for a separate storage of working tools and working accessories such that the working tools and the working accessories may each be independently approached, the tool box comprising (a) a main compartment for storage of the working tools, the main compartment being defined by a front wall, a rear wall, a left wall, a right wall and a bottom collectively defining a storage space, at least one of the walls being formed with an outwardly facing recession; (b) a cover for covering the main compartment, the cover being hingedly connected to one of the walls of the compartment; (c) at least one cover-compartment securing mechanism for alternately securing and releasing the cover; (d) at least two outwardly opening pivoting bins pivotaly mounted within the recession, the bins being for storage of the working accessories; and (e) a bins securing mechanism for alternately securing and releasing the bins.

18 Claims, 10 Drawing Sheets

TOOL BOX WITH FOLDING BINS

This application is a continuation-in-part of U.S. patent application Ser. No. 08/700,018 which was filed on Aug. 20, 1996, now abandoned.

FIELD AND BACKGROUND OF THE INVENTION

The present invention relates to a tool box and, more particularly, to a tool box suitable for storage of working tools in a main compartment, and small working accessories in pivoting bins located externally to the main compartment.

It is convenient to store working tools such as but not limited to a hammer, a drill, a screw drive, a spanner, etc., in a tool box next to their accessories such as but not limited to nails, screws, pins, rings, nuts, drilling accessories, etc.

To this end, a tool box typically includes a main compartment for storage of the working tools, a cover for covering the compartment and an inner tray divided into small sections for accommodating the various working accessories, the inner tray is located within the main compartment, typically covering the tools from above, and is not accessible when the cover is in a closed position, closing the main compartment.

This construction suffers two main limitations. First, as the tray is located within the main compartment, the cover of the tool box is to be opened to permit access to the accessories accommodated in the tray. And second, even when the cover is opened, access to the tools is limited by the presence of the tray which therefore has to be removed out of the compartment prior to using a tool stored in the main compartment or storing a tool within the main compartment.

There is thus a widely recognized need for, and it would be highly advantageous to have, a tool box suitable for storage of working tools in a main compartment, and small accessories in pivoting bins located externally to the main compartment, such that each of the tools and/or the accessories may be independently approached.

SUMMARY OF THE INVENTION

According to the present invention there is provided a tool box with external pivoting bins for a separate storage of working tools and working accessories such that the working tools and the working accessories may each be independently approached.

According to further features in preferred embodiments of the invention described below, the tool box comprising (a) a main compartment for storage of the working tools, the main compartment being defined by a front wall, a rear wall, a left wall, a right wall and a bottom collectively defining a storage space, at least one of the walls being formed with an outwardly facing recession; (b) a cover for covering the main compartment, the cover being hingedly connected to one of the walls of the compartment; (c) at least one cover-compartment securing mechanism for alternately securing and releasing the cover; (d) at least two outwardly opening pivoting bins pivotaly mounted within the recession, the bins being for storage of the working accessories; and (e) a bins securing mechanism for alternately securing and releasing the bins.

According to still further features in the described preferred embodiments the at least one cover-compartment securing mechanism and the bins securing mechanism are a single securing mechanism.

According to still further features in the described preferred embodiments the at least one cover-compartment securing mechanism includes a left, a right and a front cover-compartment securing mechanisms, the left cover-compartment securing mechanism secures the cover to the left wall of the main compartment, the right cover-compartment securing mechanism secures the cover to the right wall of the main compartment and the front cover-compartment securing mechanism secures the cover to the front wall of the main compartment.

According to still further features in the described preferred embodiments the front cover-compartment securing mechanism and the bins securing mechanism are a single securing mechanism.

According to still further features in the described preferred embodiments the at least two bins are connected therebetween via a simultaneous operation mechanism for limiting their operation to a simultaneous operation.

According to still further features in the described preferred embodiments the simultaneous operation mechanism is a rod connecting the bins.

According to still further features in the described preferred embodiments the cover includes a handle for carrying the tool box.

According to still further features in the described preferred embodiments the tool box further comprising (f) a locking mechanism for locking the cover to the main compartment.

According to still further features in the described preferred embodiments the cover includes a meter.

According to still further features in the described preferred embodiments the tool box further comprising (f) a slide-in partition for dividing the main compartment into chambers.

According to still further features in the described preferred embodiments the slide-in partition is formed having circular perforations of known diameters to serve as a diameter measure.

According to still further features in the described preferred embodiments the slide-in partition is formed having a ruler.

According to still further features in the described preferred embodiments the tool box, further comprising (f) external attachments for externally removeably attaching working items thereto.

According to still further features in the described preferred embodiments the attachments are selected from the group consisting of level attachments and cable holder attachments.

According to still further features in the described preferred embodiments the tool box as in claim 1, further comprising (f) a tote tray being shaped and dimensioned to rest in the upper portion of the storage space.

According to still further features in the described preferred embodiments the tote tray includes compartments and a handle.

According to still further features in the described preferred embodiments at least some of the compartments are covered by a cover.

According to still further features in the described preferred embodiments the cover includes a holder for holding drill-bits.

The present invention successfully addresses the shortcomings of the presently known configurations by providing a tool box suitable for storage of working tools in a main compartment, and small accessories in pivoting bins located externally to the main compartment, such that each of the tools and/or the accessories may be independently approached.

BRIEF DESCRIPTION OF THE DRAWINGS

The invention herein described, by way of example only, with reference to the accompanying drawings, wherein.

DESCRIPTION OF THE PREFERRED EMBODIMENTS

Figure 1:
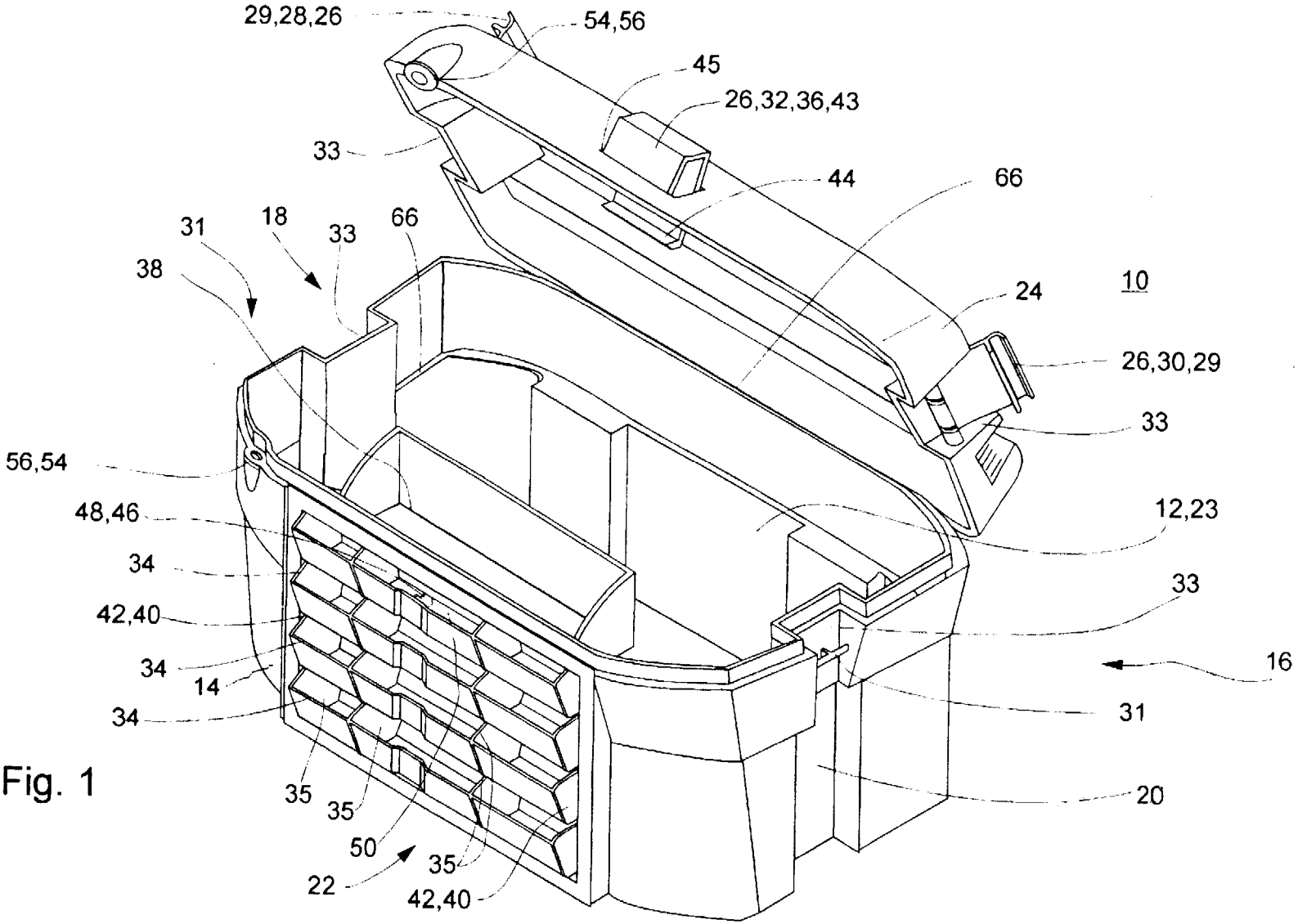
FIG. 1 is a perspective front view of a tool box in an opened position according to the present invention.

The present invention is of a tool box with external pivoting bins which can be used to store working tools and working accessories. Specifically, the present invention can be used to separately store working tools within the main compartment of the box and working accessories within the bins such that the working tools and the working accessories may each be independently approached.

The principles and operation of a tool box according to the present invention may be better understood with reference to the drawings and accompanying descriptions.

Referring now to the drawings, FIGS. 1–5 illustrate some preferred embodiments of the tool box according to the present invention, referred to hereinbelow as box 10.

Figure 2:
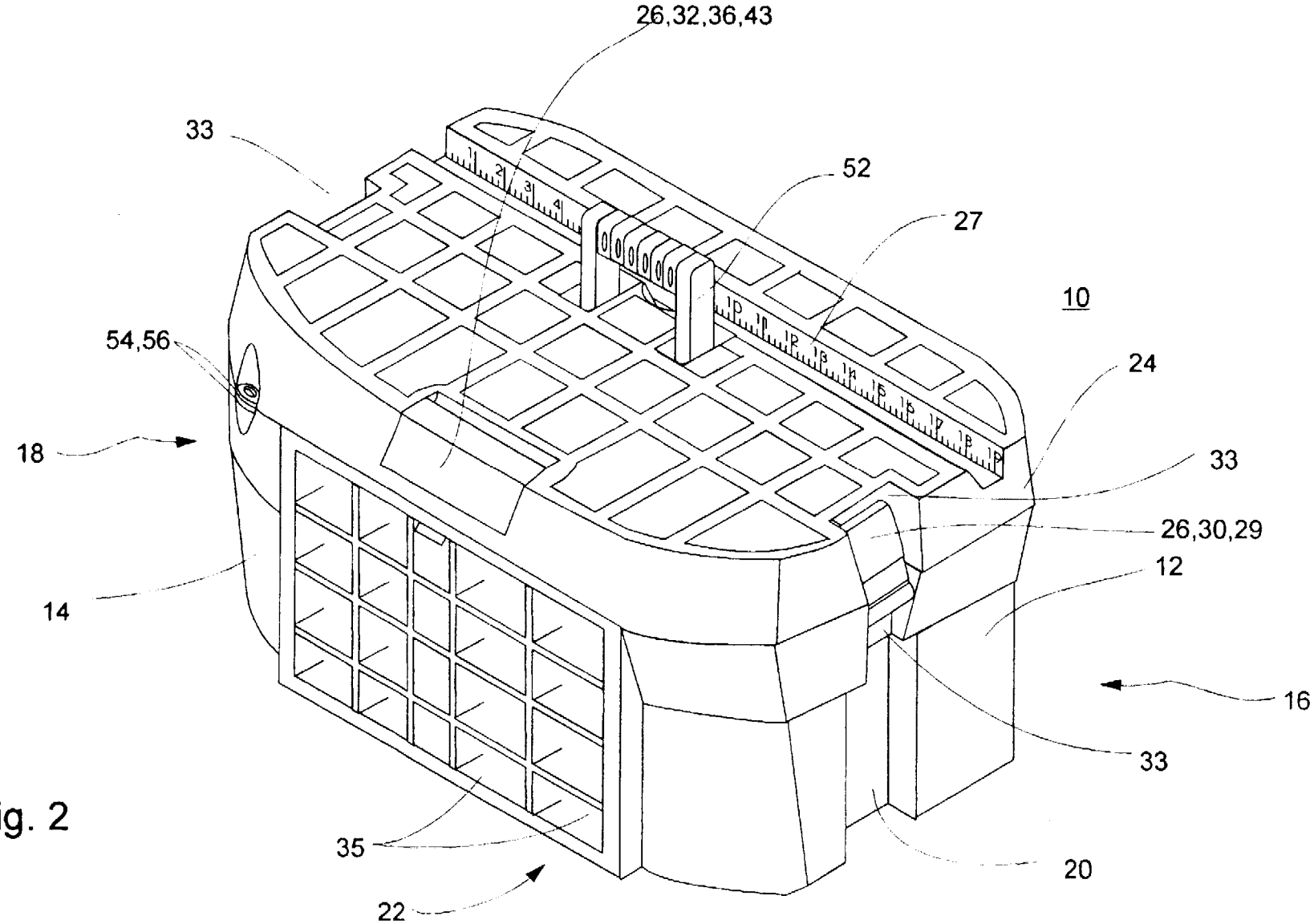
FIG. 2 is a perspective front view of the tool box of FIG. 1 in a closed position.

As best seen in FIGS. 1 and 2, box 10 includes a main compartment 12 for storage of working tools such as but not limited to a hammer, a drill, a screw drive, a spanner, etc.

Main compartment 12 is defined by a front wall 14, a rear wall 16, a left wall 18, a right wall 20 and a bottom 22, collectively defining a storage space 23 for working tools (not shown).

Figure 3:
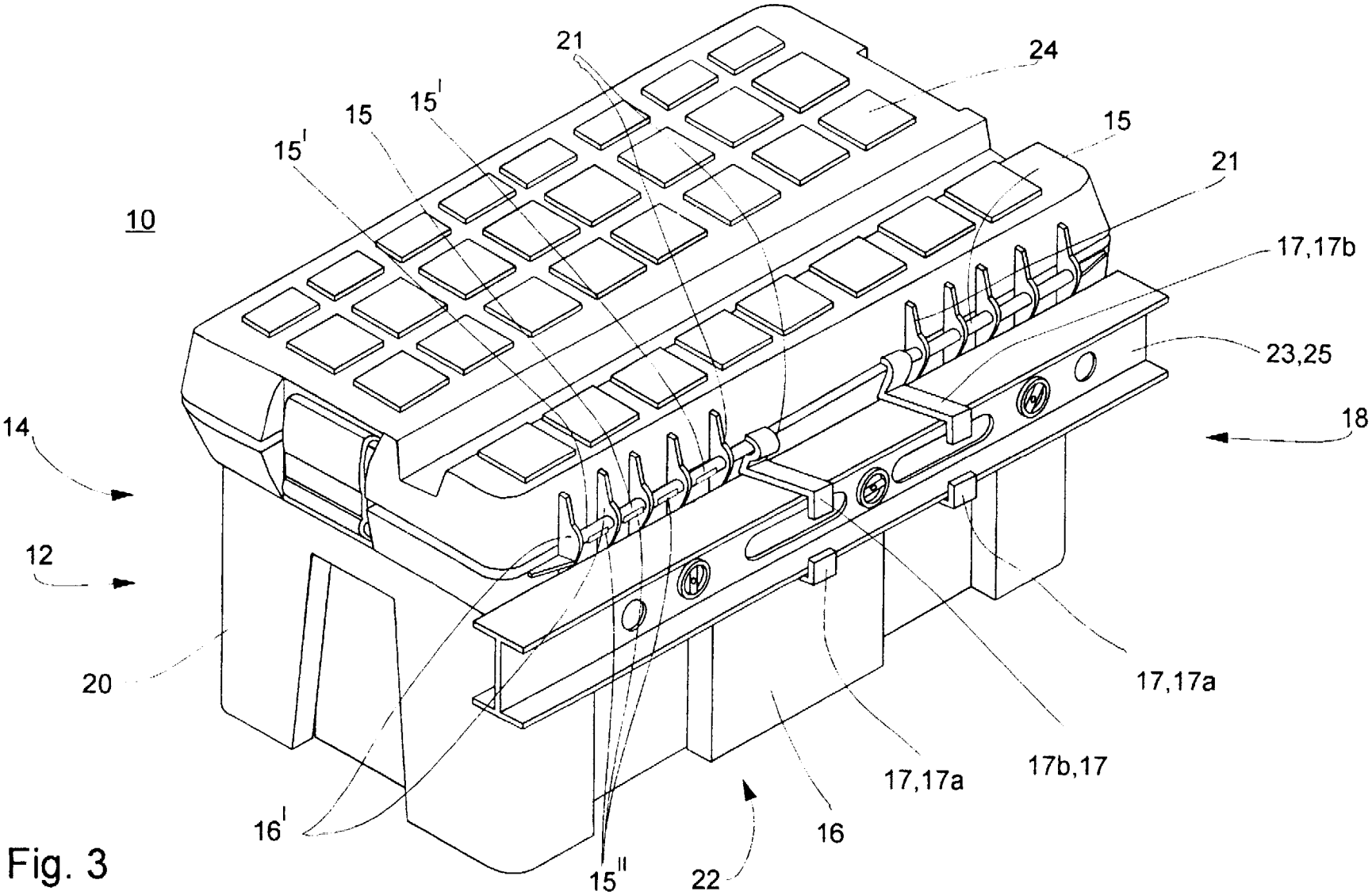
FIG. 3 is a perspective rear view of the tool box of FIG. 1 in a closed position, having a level attached thereto.
Figure 4:
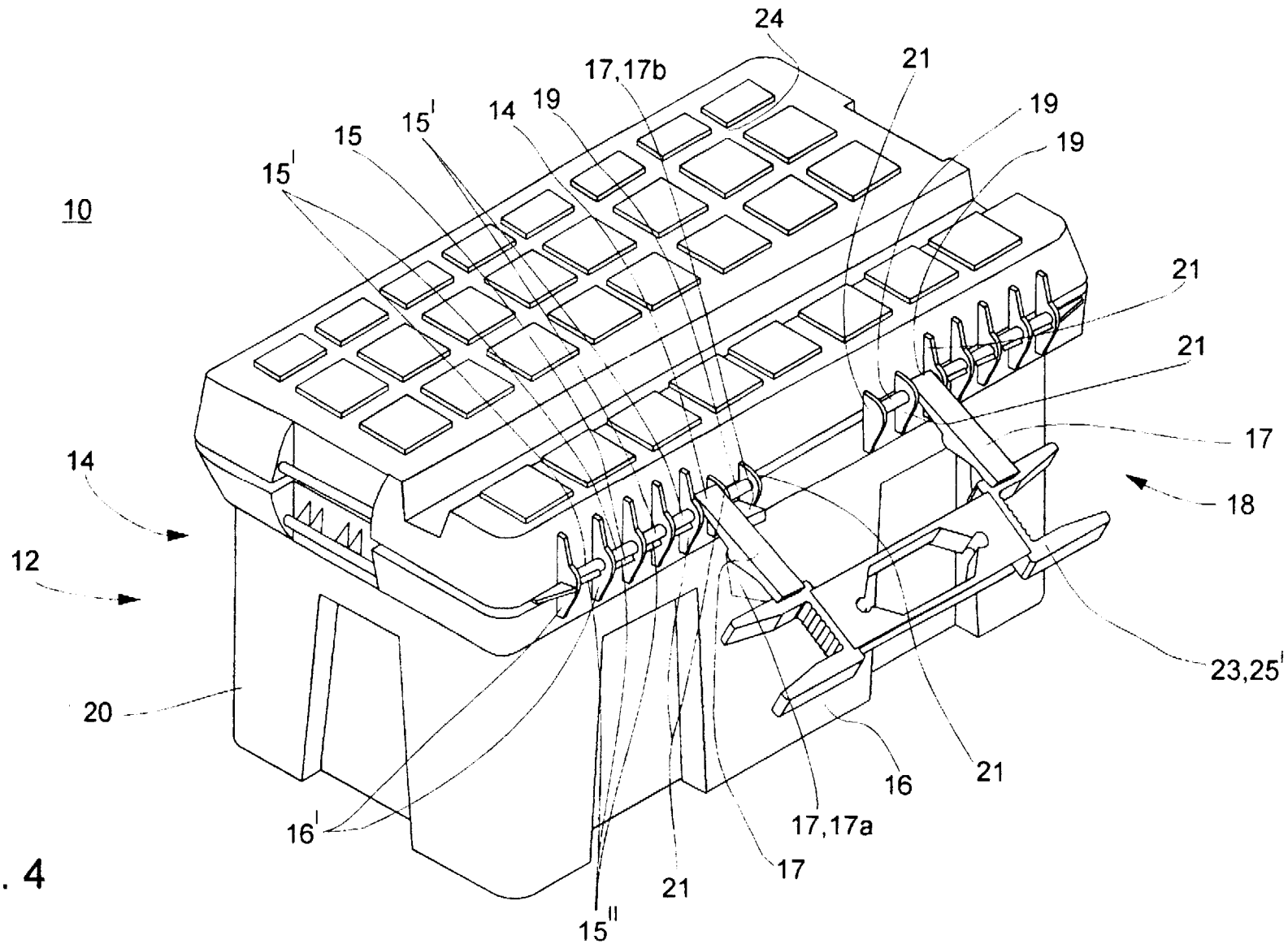
FIG. 4 is a perspective rear view of the tool box of FIG. 1 in a closed position, having a cable holder attached thereto.
Figure 5:
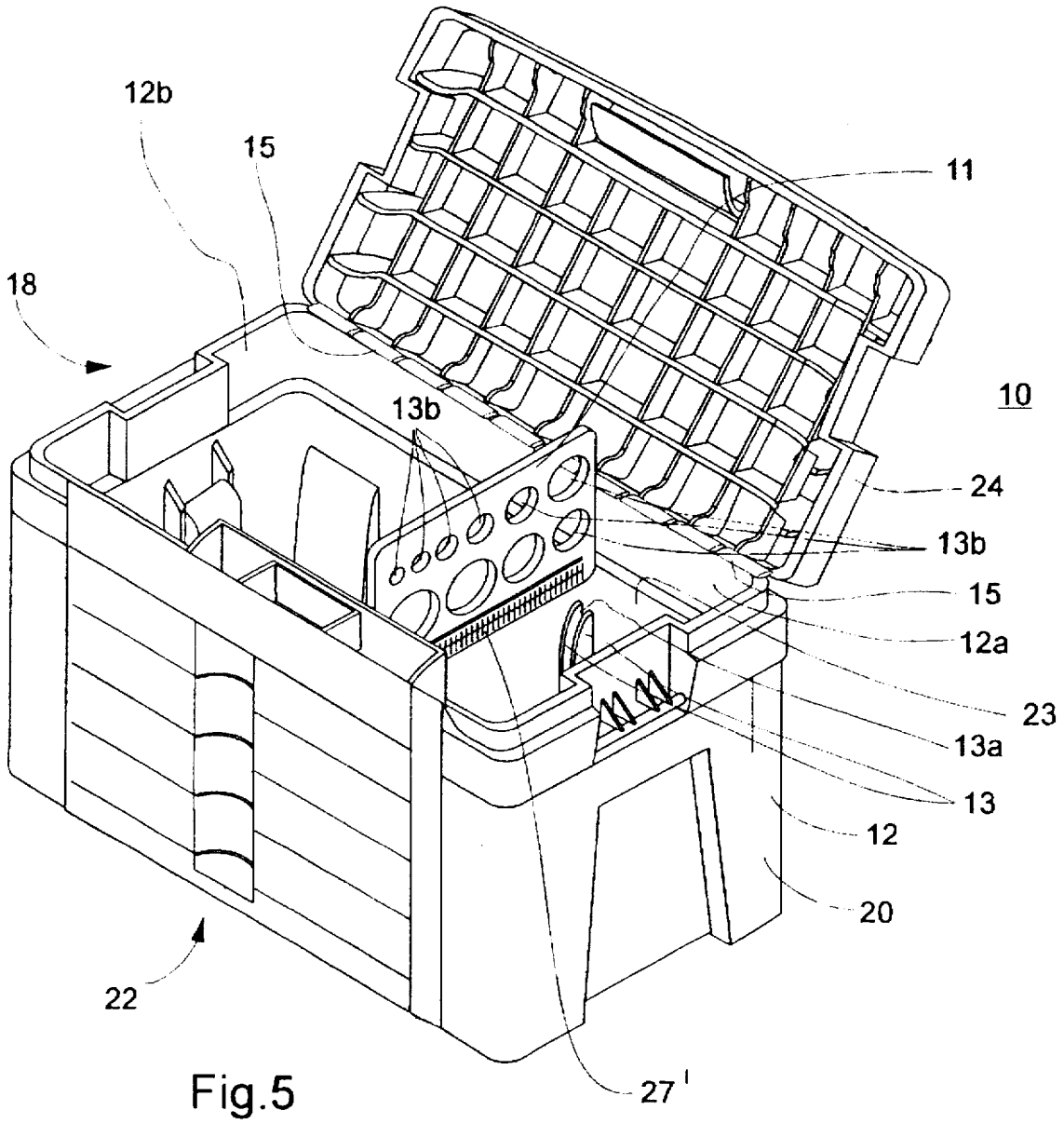
FIG. 5 is a perspective front view of the tool box of FIG. 1 in an opened position, showing a partition to be therein implemented.

Box 10 further includes a cover 24 for covering main compartment 12. Cover 24 is hingedly connected to one of walls 14, 16, 18 or 20 of compartment 12, preferably, as best seen in FIGS. 3–5, cover 24 is hingedly connected via hinges 15 to rear wall 16 of compartment 12. Hingedly connecting cover 24 to compartment 12 permits opening and closing tool box 10. In a preferred embodiment, as best seen in FIGS. 3–4, each of hinges 15 includes a rod 15' fixedly attached to rear wall 16 via few spaced apart ribs 16', and further includes rod accepting mechanisms 15" fixedly attached to cover 24, such that cover 24 may pivot about rod 15'.

In a preferred embodiment, as best seen in FIG. 2, cover 24 is supplemented with a meter 27.

In another preferred embodiments, as shown in FIG. 5, space 23 of compartment 12 is subdivided by a slide-in partition 11 into first **12*a* and second 12*b* chambers. In a preferred embodiment, partition 11 is slideably accommodated within a gap 13*a* formed between two substantially parallel rails 13 attached to or integrally formed with the inner walls of compartment 12. In a preferred embodiment partition 11 is formed with successively increasing circular perforations 13*b* having their diameter indicated (not shown), which may therefore be used as a diameter measure. In a preferred embodiment partition 11 further includes a ruler (meter) 27'. Diameter measure and ruler 27' are suitable for measurements when partition 11 is not engaged within compartment 12**.

In another preferred embodiment, as best seen in FIGS. 3–4, rear wall 16 of main compartment 12 is supplemented with attachments or holders 17. Attachments 17 are removeably connected to dedicated rods 19 held between extending ribs 21 (similar to ribs 16' described hereinabove), themselves fixedly attached or integrally formed with rear wall 16. In a preferred embodiment, rods 19 are the extensions of rods 15'. Attachments 17 are for externally attaching worling items 23 onto tool box 10. The specific construction of attachments 17 depends on the nature of the attached item 23.

Thus for example, in FIG. 3, item 23 is a level 25 and therefore the construction of attachments 17 is selected suitable to engage level 25. To this end each of attachments 17 includes two connected arms **17*a* and 17*b* spaced and dimensioned to form a clasp for tightly accommodating level 25. In this case attachments 17 are preferably made from a flexible material, e.g., flexible plastic, metal, etc. such that level 25 can be removeably attached thereto between arms 17*a* and 17*b***.

In FIG. 4, item 23 is a cable holder 25' and therefore the construction of attachments 17 is selected suitable to connect cable holder 25'. In this case attachments 17 have a simpler construction, wherein each is formed as an extended arm suitable to engage holder 25'. Cable holder 25' is for storing long lengths of cable, for example, electric cable, extension cord, and the like, as well known in the art.

In a preferred configuration, as best seen in FIG. 4, attachments 17 for both lever 25 and cable holder 25' may coincide on a single tool box 10.

As box 10 is to be carried by a user from place to place, main compartment 12 and cover 24 are preferably constructed from a plastic material such as polypropylene to ensure its light weight.

Box 10 further includes at least one cover-compartment securing mechanism 26 for alternately securing and releasing cover 24. In a preferred embodiment, as best seen in FIGS. 1–2, box 10 includes a left 28, a right 30 and a front 32 cover-compartment securing mechanisms. Left cover-compartment securing mechanism 28 secures cover 24 to left wall 18 of main compartment 12, right cover-compartment securing mechanism 30 secures cover 24 to right wall 20 of main compartment 12, whereas front cover-compartment securing mechanism 32 secures cover 24 to front wall 14 of main compartment 12.

Providing box 10 with three securing mechanisms 28, 30 and 32, arranged as shown in FIGS. 1 and 2 in a concentric arrangement ensures a firm secure for cover 24 when closed, as shown for example in FIG. 2.

As best seen in FIG. 1, in a preferred embodiment, left 28 and right 30 cover-compartment securing mechanisms are each formed as a catch 29, as well known in the art, wherein catches 29 are rotatably accommodated by the left and right sides of cover 24 and may therefore, when cover 24 is closed, be securely engaged by suitable pins 31 located on left 18 and right 20 walls of main compartment 12.

In a preferred embodiment catches 29 and pins 31 are accommodated within especially designed recessions 33 formed in both left and right sides of cover 24 and left 18 and right 20 walls, such that, as best seen in FIG. 2, when cover 24 is closed and left 28 and right 30 cover-compartment securing mechanisms are secured, they do not protrude from the general outline of box 10.

As best seen in FIGS. 1–2, box 10 further includes at least two pivoting bins 34 externally located on one of walls 14, 16, 18 or 20 of compartment 12, preferably, as for example shown in FIGS. 1 and 2, bins 34 are located on front wall 14. Bins 34 are for storage of working accessories such as but not limited to nails, screws, pins, rings, nuts, drilling accessories (e.g., drill-bits), etc. From a mechanical point of view, bins 34 are pivoting between their closed and opened positions, yet as a component of box 10, bins 34 may also be regarded as folded when closed, and erected when opened, i.e., folding bins.

In a preferred embodiment box 10 includes four bins 34, each of which includes vertical partitions 35 such that different types of working accessories may each be accommodated in a different partition 35.

Bins 34 are preferably constructed from a transparent material, e.g., a transparent plastic material such as but not limited to transparent polypropylene. Constructing bins 34 from a transparent material ensures that a user can see the accessories accommodated within each of bins 34 or partitions 50.

In a preferred embodiment, as best seen in FIGS. 1, one of the walls of main compartment 12, e.g., front wall 14, is formed with an outwardly facing recession 38 for pivotaly accommodating bins 34. As best seen in FIG. 2, thus constructing wall 14 ensures that bins 34 do not protrude from the general outline of wall 14 when they are closed.

Each of bins 34 is rotatably accommodated within recession 38 via a vertical hinge (internal, not shown), enabling opening and closing bins 34.

As best seen in FIG. 1, in a preferred embodiment, bins 34 are connected therebetween via a simultaneous operation mechanism 40. Thus connecting bins 34 ensures their simultaneous operation which is presently preferred. In a preferred embodiment simultaneous operation mechanism 40 is at least one, preferably two rods 42 connecting between bins 34.

Box 10 further includes at least one bins securing mechanism 36 for alternately securing and releasing bins 34. In the preferred embodiment, wherein simultaneous operation mechanism 40 ensures simultaneous operation of bins 34, as described hereinabove, a single bins securing mechanism 36 is sufficient for alternately securing and releasing all of bins 34. Yet, in a case where each of bins 34 is separately operated (not shown), each of bins 34 may have a specified securing mechanism such as but not limited to a latch (not shown).

Furthermore, in the preferred embodiment, wherein simultaneous operation mechanism 40 ensures simultaneous operation of bins 34, as described hereinabove, one of cover-compartment securing mechanisms 26, e.g., front cover-compartment securing mechanism 32, and bins securing mechanism 36 are a single securing mechanism 43, serving both functions.

In a preferred embodiment, as best seen in FIG. 1, single securing mechanism 43 includes a latch 44 moveably (e.g., pivotaly) accommodated within a dedicated opening 45 formed in cover 24. Single securing mechanism 43 further includes a latch engaging means 46 in the form of a recession 48 formed in a specified partition 50 located in most upper bin 34. The operation of single securing mechanism 43 is as follows. When cover 24 is closed, latch 44 engages recession 48 and as a result bins 34 are securely closed as well as main compartment 12, whereas when moving latch 44 such that it is no longer engaging recession 48, both cover 24 and bins 34 are released and can be opened.

Figure 6A:
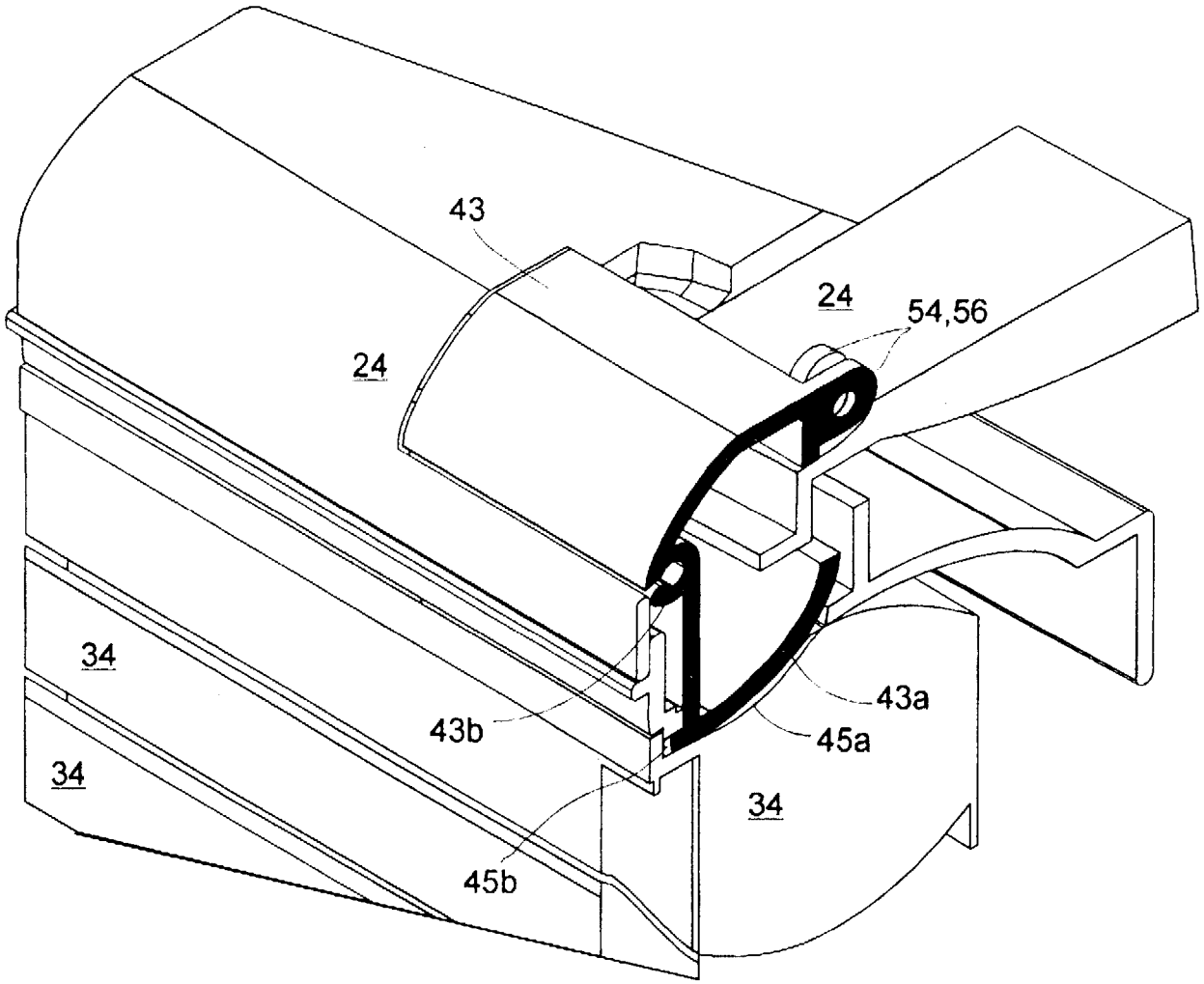
FIGS. 6*a–b* are enlarged views of a cross section through a securing mechanism according to the present invention in two of its operation modes.
Figure 6B:
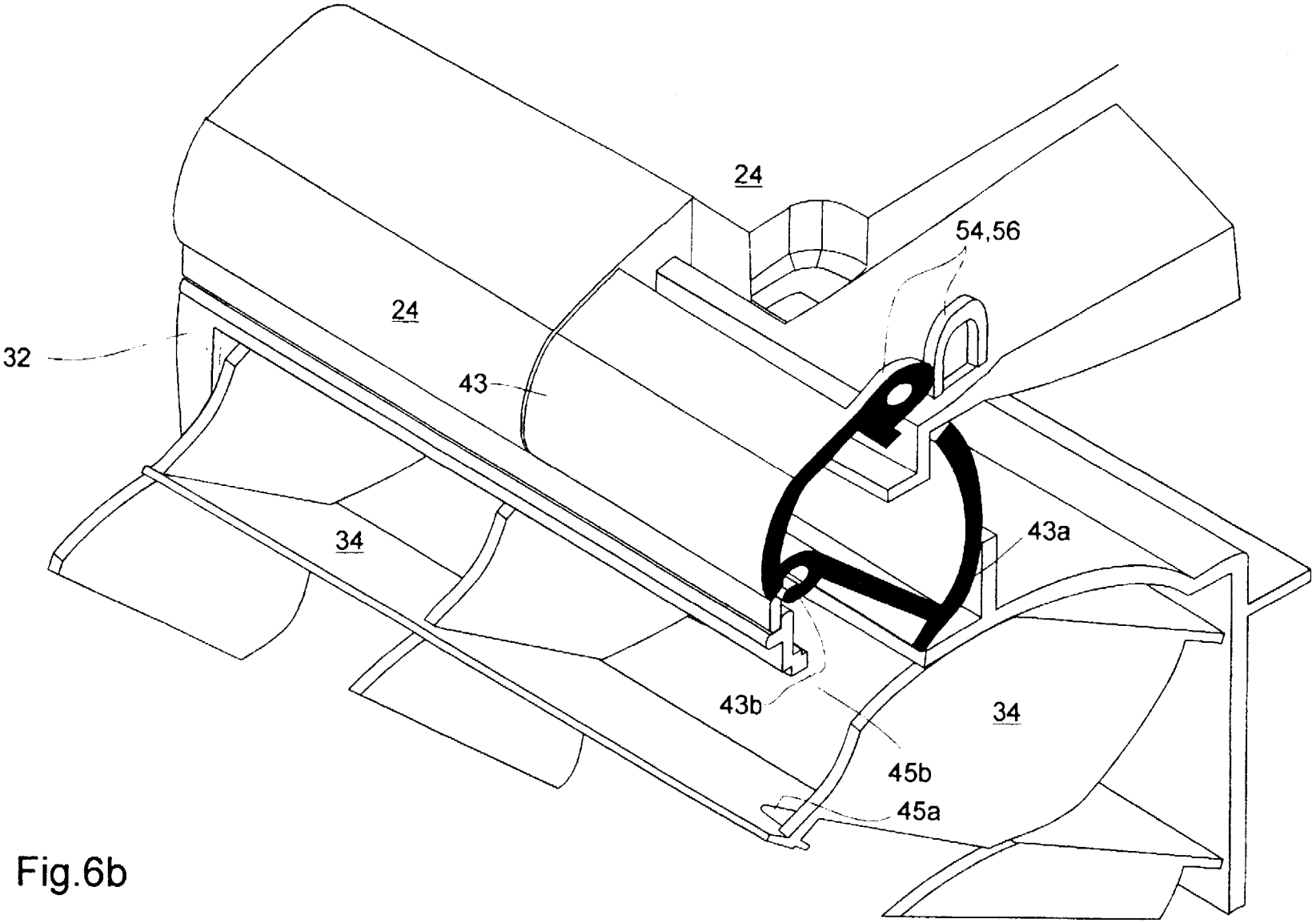

With reference now to FIGS. **6*a–b*. FIGS. 6*a–b* present two operation modes of another preferred embodiment of single securing mechanism 43. According to this configuration, single securing mechanism 43 includes a latch 43*a*. Securing mechanism 43 is hingedly accommodated in front of cover 24 via hinge 43*b*, such that in a first operation mode, as shown in FIG. 6*a*, latch 43*a* engages upper bin 34 via a recession 45*a* formed thereat, and latch 43*a* engages front wall 32 of compartment 12 via a pocket 45*b*, formed between front wall 32 and upper bin 34 when in its closed position. On the other hand, in a second operation mode, as shown in FIG. 6*b*, mechanism 43 is rotated about hinge 43*b* such that latch 43*a* no longer engages recession 45*a* and pocket 45*b*. In this case (i) bins 34 are released and can therefore be opened as they are no longer secured; (ii) provided that left 28 and right 30 cover-compartment securing mechanisms are released (as shown for example in FIG. 1), cover 24 can be opened; and (iii) provided that left 28 and right 30 cover-compartment securing mechanisms are secured (as shown for example in FIG. 2), cover 24 is maintained closed while bins 34** open.

The design of box 10 presented in FIGS. 1–5 is preferably selected such that the weight of the accessories (not shown) accommodated within bins 34 ensures their opening due to gravity the minute latch 44 is released from recession 48.

Nevertheless, an arrangement in which single securing mechanism 43 is implemented in front wall 32 (not shown) is also possible. In this case single securing mechanism 43 can be designed to have three operation modes as follows. In the first, both cover 24 and bins 34 are secured close. In the second, cover 24 is released and therefore can be opened, whereas bins 34 are secured close. And in the third, both cover 24 and bins 34 are released and can therefore be opened.

As shown in FIG. 2, in a preferred embodiment cover 24 includes a handle 52 for carrying tool box 10 from place to place.

In a preferred embodiment tool box 10 further includes a locking mechanism 54 for locking cover 24 to main compartment 12. In a preferred embodiment, as shown for example in FIGS. 1–2, locking mechanism 54 is in the form of two rings 56 one located on cover 24 whereas the other is located on main compartment 12, such that when cover 24 is closed, rings 56 are aligned in a parallel orientation and may therefore be locked together by a simple key operated lock (not shown) or any equivalent, e.g., a numbers combination lock.

In another preferred embodiment, as shown for example in FIGS. **6*a–b*, locking mechanism 54 is in the form of two rings 56 one located on cover 24 whereas the other is located on securing mechanism 43, such that when securing mechanism 43 is securing cover 24 in its closed position (FIG. 6*a*), rings 56** are aligned in a parallel orientation and may therefore be locked together by a simple key operated lock (not shown) or any equivalent, e.g., a numbers combination lock.

It will be appreciated that other types of key operated locking mechanisms or equivalents may be implemented in box 10 to serve the locking fuiction, all as well known in the art.

The operation of box 10 according to its preferred embodiments described hereinabove is as follows.

Working tools and working accessories are accommodated in main compartment 12 and bins 34, respectively.

When not in use, or when carried from place to place, box 10 is kept closed. In its closed position cover 24 of box 10 is secured to main compartment 12 via left 28, right 30 and front 32 cover-compartment securing mechanisms, and bins 34 are secured close via bins securing mechanism 36. In the preferred embodiment front cover-compartment securing mechanism 32 and bins securing mechanism 36 are formed as a single securing mechanism 43, all as described hereinabove. Preferably a key lock is used to lock box 10 via locking mechanism 54.

When box 10 is in use, the key lock is removed, left 28, and right 30 cover-compartment securing mechanisms and single securing mechanism 43 are released and as a result bins 34 and cover 24 may be opened. Yet, if only an accessory accommodated within bins 34 is in need, bins securing mechanism 36 may be opened while left 28, and right 30 cover-compartment securing mechanisms are kept secured. In this case bins 34 open while cover 24 is maintained securely closed.

Box 10 has major advantages over prior art designs having a tray located within the main compartment. As bins 34 are externally located working accessories and working tools are separately approachable, simplifying their use.

Figure 7A:
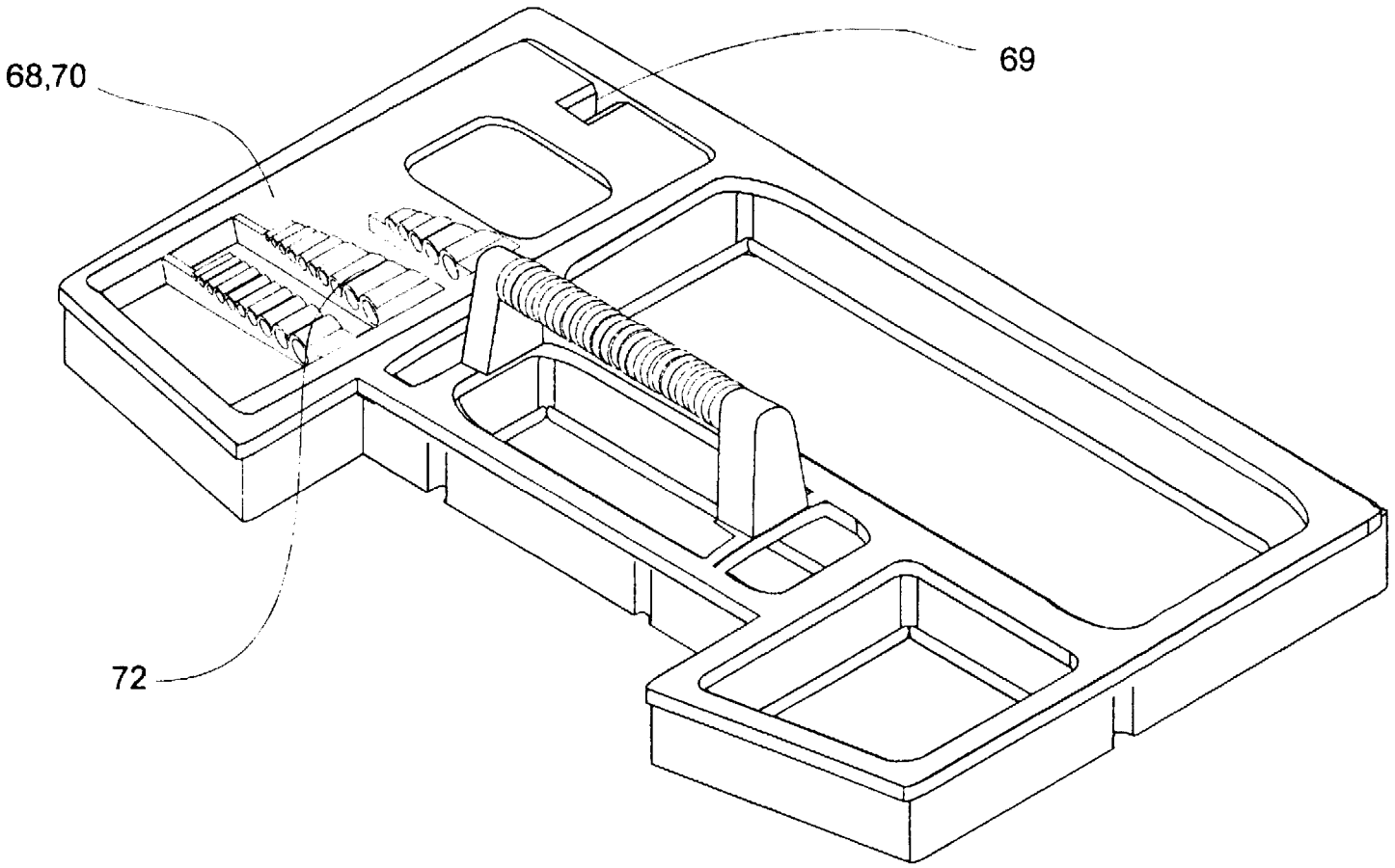
FIGS. 7*a–c* are perspective views of a tote tray, and a cover to a part thereof according to the present invention, the cover includes a drill-bits holder.
Figure 7B:
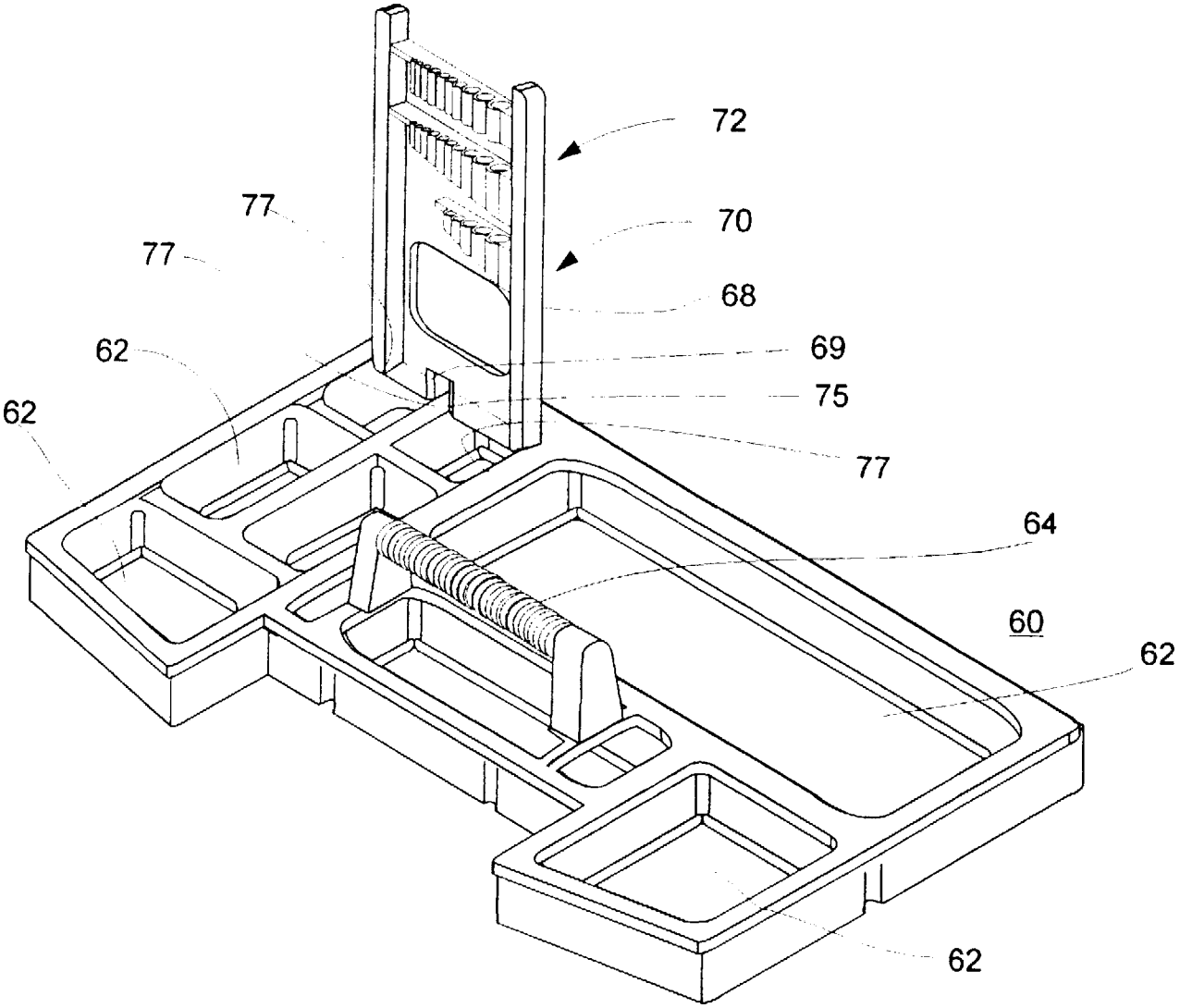
Figure 7C:
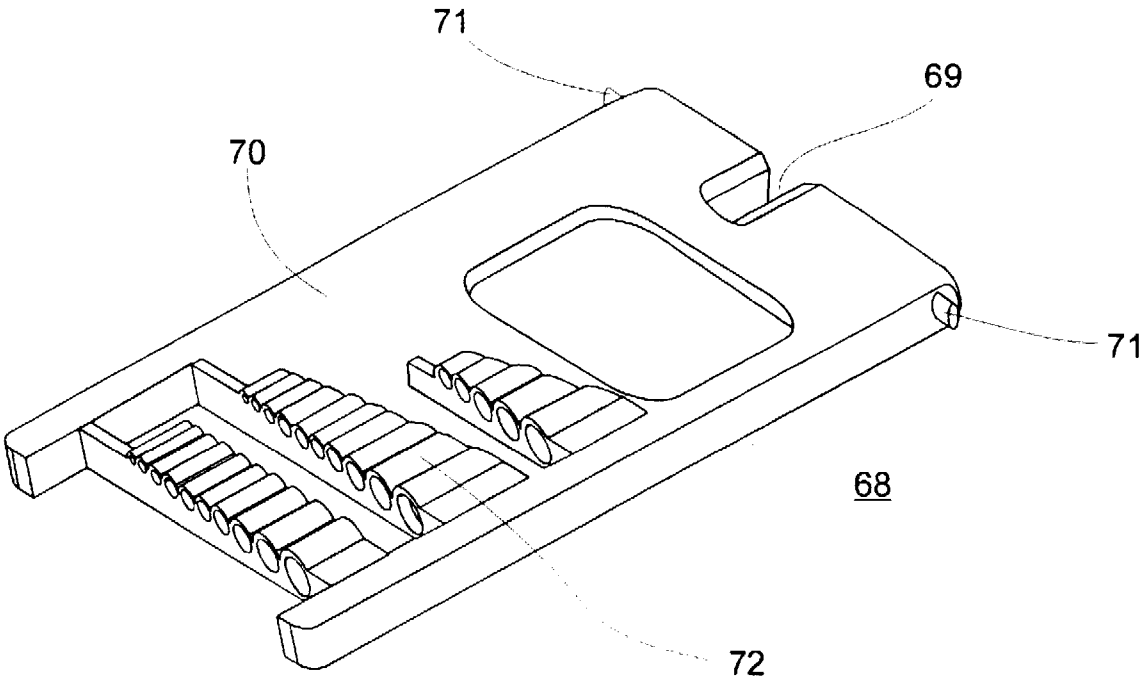

Nevertheless, with reference now to FIGS. 7*a–c*, box 10 may be further supplemented with a tote tray 60. Tray 60 includes few compartments 62 and a handle 64. Tray 60 is shaped and dimensioned to rest in the upper portion of storage space 23 of compartment 12 (both best seen in FIG. 1). To this end, as further shown in FIG. 1, compartment 12 is formed having tray supports 66, which protrude into space 23 and dictate the position of tray 60 when thereat removeably implemented.

In a preferred embodiment, some of compartments 62 are covered by a cover 68 hingedly engaged by tray 60. Hingedly engaging cover 68 onto tray 60 is effected via a dedicated slit 69 formed in cover 68 and pins 71 extending from cover 28. Slit 69 is engaged by a matching protrusion 73 protruding from tray 60. Protrusion 73 may be a part of a partition 75 used to form compartments 62. Pins 71 are rotatably accepted by dedicated holes 77 formed in tray 60.

Cover 68 is showed opened in FIG. 7*b*, closed in FIG. 7*a* and by itself in FIG. 7*c*. Cover 68 has an upper side. In a preferred embodiment upper side 70 of cover 68 includes a holder 72 for holding drill-bits of vaying sizes.

While the invention has been described with respect to a limited number of embodiments, it will be appreciated that many variations, modifications and other applications of the invention may be made.

What is claimed is:

1. A tool box for a separate storage place of working tools and working accessories such that the working tools and the working accessories may each be independently approached, the tool box comprising:

(a) a main compartment for storage of the working tools, said main compartment being defined by a front wall, a rear wall, a left wall, a right wall and a bottom collectively defining a storage space, at least one of said walls being formed with an outwardly facing recession;

(b) a cover for covering said main compartment, said cover being hingedly connected to one of said walls of said compartment;

(c) at least one cover-compartment securing mechanism for alternately securing and releasing said cover;

(d) at least two permanently external facing pivoting bins pivotally mounted onto said wall formed with said recession, said bins being for storage of the working accessories; and (e) a bins securing mechanism for alternately securing and releasing said bins.

2. A tool box as in claim 1, wherein said at least one cover-compartment securing mechanism and said bins securing mechanism are a single securing mechanism.

3. A tool box as in claim 1, wherein said at least one cover-compartment securing mechanism includes a left, a right and a front cover-compartment securing mechanisms, said left cover-compartment securing mechanism secures said cover to said left wall of said main compartment, said right cover-compartment securing mechanism secures said cover to said right wall of said main compartment and said front cover-compartment securing mechanism secures said cover to said front wall of said main compartment.

4. A tool box as in claim 3, wherein said front cover-compartment securing mechanism and said bins securing mechanism are a single securing mechanism.

5. A tool box as in claim 1, wherein said at least two bins are connected therebetween via a simultaneous operation mechanism for limiting their operation to a simultaneous operation.

6. A tool box as in claim 5, wherein said simultaneous operation mechanism is a rod connecting said bins.

7. A tool box as in claim 1, wherein said cover includes a handle for carrying the tool box.

8. A tool box as in claim 1, further comprising:

(f) a locking mechanism for locking said cover to said main compartment.

9. A tool box as in claim 1, wherein said cover includes a meter.

10. A tool box as in claim 1, further comprising:

(f) a slide-in partition for dividing said main compartment into chambers.

11. A tool box as in claim 10, wherein said slide-in partition is formed having circular perforations of known diameters to serve as a diameter measure.

12. A tool box as in claim 10, wherein said slide-in partition is formed having a ruler.

13. A tool box as in claim 1, further comprising:

(f) external attachments for externally removeably attaching working items thereto.

14. A tool box as in claim 13, wherein said attachments are selected from the group consisting of level attachments and cable holder attachments.

15. A tool box as in claim 1, further comprising:

(f) a tote tray being shaped and dimensioned to rest in the upper portion of said storage space.

16. A tool box as in claim 15, wherein said tote tray includes compartments and a handle.

17. A tool box as in claim 16, wherein at least some of said compartments are covered by a cover.

18. A tool box as in claim 17, wherein said cover of said compartments of said tote-tray includes a holder for holding drill-bits.

* * * * *